US005363021A

United States Patent [19]

MacDonald

[11] Patent Number: 5,363,021

[45] Date of Patent: Nov. 8, 1994

[54] MASSIVELY PARALLEL ARRAY CATHODE

[75] Inventor: Noel C. MacDonald, Ithaca, N.Y.

[73] Assignee: Cornell Research Foundation, Inc., Ithaca, N.Y.

[21] Appl. No.: 89,821

[22] Filed: Jul. 12, 1993

[51] Int. Cl.[5] ..... H01J 29/70; H01J 29/72

[52] U.S. Cl. ..... 315/366; 313/336; 313/304; 313/309; 313/351

[58] Field of Search ..... 315/366, 304, 309, 351; 313/422, 336

[56] References Cited

U.S. PATENT DOCUMENTS

| | | | |
|---|---|---|---|
| 3,453,478 | 5/1966 | Shoulders et al. . | |
| 3,921,022 | 11/1975 | Levine . | |
| 3,970,887 | 7/1976 | Smith et al. . | |
| 4,095,133 | 6/1978 | Hoeberecths . | |
| 4,663,559 | 5/1987 | Christensen | 313/336 |
| 4,721,885 | 1/1988 | Brodie . | |
| 4,746,621 | 5/1988 | Thomas et al. . | |
| 4,845,048 | 7/1989 | Tamaki et al. . | |
| 4,983,878 | 1/1991 | Lee et al. . | |
| 5,072,288 | 12/1991 | MacDonald et al. . | |
| 5,198,390 | 3/1993 | MacDonald et al. . | |
| 5,199,917 | 4/1993 | MacDonald et al. . | |
| 5,235,244 | 8/1993 | Spindt | 313/495 |

OTHER PUBLICATIONS

Arney et al., "Formation of Submicron Silicon-on-Insulator Structures by Lateral Oxidation of Substrate-Silicon . . . ", J. Vac. Sci. Tech. B 6 (1) Jan./Feb. 1988.

Sanford et al., "Electron Emission Properties of Laser Pulsed GaAs Negative Electron Affinity Photocathodes", J. Vac. Sci. Technol. B 8(6), Nov./Dec. 1990.

Sanford et al., "Electron Optical Characteristics of Negative Electron Affinity Cathodes", J. Vac. Sci. Technol., B 6(6) Nov./Dec. 1988.

Theodore et al., "TEM Characterization of Defect Configurations in Submicron SOI Structures", Proc. 6th Int. Conf., Oxford, UK, 10-13 Apr. 1989.

Spallas et al., "Self-Aligned Silicon-Strip Field Emitter Array", Inst. Phys, Conf. Ser. No. 99: Section 1; 1989.

Chin et al., "Field Emitter Tips for Vacuum Microelectronic Devices", J. Vac. Sci. Technol. A., vol. 8, No. 4, Jul./Aug. 1990.

Zhang et al., "An RIE Process for Submicron, Silicon Electromechanical Structures", IEEE 1991, pp. 520-523.

*Primary Examiner*—Theodore M. Blum

*Attorney, Agent, or Firm*—Jones, Tullar & Cooper

[57] ABSTRACT

A massively parallel electron beam array for controllably imaging a target includes a multiplicity of emitter cathodes, each incorporating one or more micron-sized emitter tips. Each tip is controlled by a control electrode to produce an electron stream, and its deflection is controlled by a multielement deflection electrode to permit scanning of a corresponding target region.

15 Claims, 8 Drawing Sheets

MASSIVELY PARALLEL ARRAY CATHODE

BACKGROUND OF THE INVENTION

This invention was made with Government support under Grant No. N00014-92-J-4091, awarded By the Advanced Research Projects Agency (ARPA) and the Office of Naval Research. The Government has certain rights in the invention.

The present invention relates, in general, to a parallel beam architecture, and more particularly to a high resolution electron beam array.

Electron beam technology is well developed, and finds use in a wide range of applications in such diverse fields as image generation in cathode ray tubes, lithography, and the like. However, there are limitations in present systems which, if overcome, would greatly expand the usefulness and applicability of such systems. For example, a scanning electron beam is used to generate images in a cathode ray tube; however, the beam must scan very rapidly over a huge area, limiting the resolution available and producing distortions at the edges of the image, where the beam spot on the CRT screen becomes elongated due to the angle of the beam.

In addition, although electron beam lithography (EBL) offers high spatial resolution (less than 50 nm), maskless lithography, the serial exposure process is very slow. Consequently, the use of EBL has been limited to nanofabrication research and development, for mask writing, and for patterning low volume, special circuits such as ASICs. Most recently EBL has been successfully used to speed the process development of high density, submicron minimum feature size (MFS), Dynamic Random Access Memory (DRAM) products, particularly in Japan. Attempts to improve the writing speed of EBL include the development of shaped beam systems, multiple beam columns, and projection lithography using a patterned cathode or patterned stencil mask, but only the shaped beam EBL systems have survived in the market place. Most of these EBL systems were developed in the 70's and early 80's when commercial field emission systems were just being introduced, lasers were expensive and not readily available, and submicron lithography was under development.

Currently, electron-beam lithography is primarily based on one of two techniques: pattern generation or pattern projection. The latter technique, in principle, delivers high throughput, but with the intrinsic limitation that a mask must be used, thus limiting the writing repertoire to imaging the mask. Further, masks can be difficult to fabricate and are basically limited to membranes, and most often to stencil membranes.

On the other hand, the pattern generation technique, using electron-beam pattern generators, is intrinsically very flexible in usage, being driven by data. However, the throughput of these generators is limited by the data path bandwidth and by their serial nature. A recent attempt at improving this technique utilizes cell projection, wherein a piece of the pattern is replicated as a "microreticle" and is imaged onto the substrate. The cell projection tool is, however, basically a variable-shape electron-beam machine, with throughput limitations for pattern geometries not associated with the cell reticle.

Another attempt to circumvent the throughput limitation of the electron-beam pattern generator has been to form multiple quasi-independent beams, which are then more or less dependently used to form the exposed resist patterns. This implementation has been unsuccessful for various reasons. Among the problems are complexity and differential beam mispositioning (the unwanted, uncontrolled movement of one beam relative to another, often caused by charge accumulation). The complexity and beam positioning problems are a result of having to form the multiple beams through some sort of beam splitting (e.g. a "fly's eye lens") or with multiple optical columns. Thus, a real need exists for an electron beam source which will provide rapid, accurate, easily focused scanning of images which can be used in a wide variety of applications. Such a source should be usable for direct image production, as in cathode ray tubes, flat display panels, and the like, and for imaging applications such as lithography processes and devices using either pattern generation or pattern projection that will operate at high speeds, will avoid differential beam positioning, that will be simple to control, and that will retain the extremely high resolution that is now only available through very slow, maskless serial exposures.

SUMMARY OF THE INVENTION

It is an object of the present invention to provide an improved electron beam cathode array for image generation or projection.

It is another object of the invention to provide an electron beam cathode array structure having a dense, addressable array of beams.

Another object of the invention is to provide a field emitter array cathode utilizing submicron tips providing point source electron beam emitters, and addressable control electrodes for said emitters.

The present invention utilizes two types of array cathodes that can be used for a stable multiple-beam pattern generator with intrinsically high throughput, while avoiding the main difficulties of previous multiple-beam machines. Further, such designs can in principle be used for a variety of other uses, including inspection, repair, metrology, and electron-beam addressable memories.

The basic concept involves the use of a regular array of point source electron emitters, fabricated using existing monolithic fabrication technology. These emitters are either miniature field emission cathodes or negative electron affinity (NEA) emitters. An array of any number of such point sources is contemplated, each with an independent electron gun lens arrangement, beam blanking, and electrostatic deflection. Suitable drive electronics are integrated into the cathode structure for this purpose, the array of electron streams, or beamlets, being formed at the cathode, each independent of the other. A blanking electrode and a small angle deflector suitable to illuminate tiled deflection fields in a small square area on the substrate are provided for each beamlet. Assuming a reasonably short optics column, with broad crossovers and/or cathode images, high resolution is achievable with 10 or more microamperes of current. Additional electron optics consists of a suitable transfer lens assembly that controls the angular and spatial beam parameters and also illuminates the final lens and main beam deflection to image the array cathode onto a suitable area on a target substrate may also be provided. The main beam deflection is preferably magnetic in the final lens, although electrical or mechanical deflection is possible. The deflection has a millimeter-size extent, with all the beams being scanned in parallel. This structure provides at least an order of magnitude increase in beam current over current electron-beam pattern generators, and a correspondingly large increase in available throughput.

Further, the electronics requirements for speed and dynamic range are reduced by the parallelism of the beams. There is a three orders of magnitude increase in independent beams, each with two orders of magnitude less beam current. Thus, for a 10 gigapixel/second machine, each beam need only be driven at a 10 megapixel/second rate to match the electronic throughput of a single-beam machine. For a 1-$\mu C/cm^2$ resist and a 60-$\mu m$ field on the substrate, 10 $\mu A$ of beam current requires 3.6 $\mu sec$ illumination, where each beamlet in this example illuminates a $2\times2$ $\mu m$ area.

Tradeoffs can be made between parallelism (cathode and electronics complexity) and electronics speed. The fundamental limitations will include the maximum available beam current for a given spot resolution (electron-electron effects), system complexity and control, and overall optics distortions and aberrations. But differential beam effects, once controlled at the cathode, are absent.

With array cathodes and suitable writing strategies and architectures, this concept combines the benefits of high-resolution electron-beam pattern generation (maskless), with the high throughput of masked lithography, but without the masks.

The present invention will be described in terms of an array of a small number of cathode emitter elements, each element being addressable and capable of emitting a beam of electrons that can be blanked and focused. Three technologies are required to produce these arrays: (1) dense field-emitter array technology or patterned negative electron affinity (NEA) cathode-array technology; (2) a multiple-level planar metallization technology to form microlenses and (3) projection electron optics to position and focus electron beams.

The main emphasis in the present disclosure is directed to field-emission cathode-array structures for projection electron-beam lithography (PEBL). However, similar addressing concepts and the multiple level metal technology developed for field emission cathodes can be used to address negative electron affinity (NEA) array cathodes. Briefly, field emitter tips are made by oxidizing patterned single crystal silicon (SCS) wafers. The single crystal silicon (SCS) tip process integrates electrical and thermal isolation, active devices, electrical contacts and multiple metallization levels, allowing isolated arrays of addressable tips and transistors to be fabricated on a single silicon chip. Active devices adjacent to each tip in the array are used to address the massively parallel tip-arrays.

The process of fabricating submicron emitter tips is described in U.S. Pat. No. 5,199,917 of Noel C. MacDonald et al, issued Apr. 6, 1993, the disclosure of which is hereby incorporated herein by reference. This process permits the fabrication of uniform cathode tips in an array of tips, and provides a technique for addressing single or multiple tips. Multiple layer metallization of submicron structures is disclosed in U.S. Pat. No. 4,746,621 to Thomas et al, issued May 24, 1989, the disclosure of which is hereby incorporated herein by reference, and such a multilayer process is usable for addressing the single or multiple tips of the present invention. The field emitter array technology described in U.S. Pat. No. 5,199,917 may include suitable gold, tungsten or polysilicon grid electrodes surrounding single emitters or groups of emitters in the array. The grid electrode is used to establish a high field at the electrode tip, and free standing tungsten or copper deflection electrodes can be formed by a chemical vapor deposition process to extend over the tips to focus the beams. The free standing structure improves high field breakdown strength with reduced parasitic capacitance and lower leakage current.

NEA devices are described by Colin A. Sanford et al in "Electron Optical Characteristics of Negative Electron Affinity Cathodes", J. Vac. Sci. Technol. B 6(6) November/December 1988, and by Colin A. Sanford et al in "Electron Emission Properties of Laser Pulsed GaAs Negative Electron Affinity Cathodes" J. Vac Sci Technol B 8(6) November/December 1990. The NEA device concept has two significant advantages. First, each array element is an independently operated and focused electron beam excited by a continuous or pulsed light (laser) source, and second, it takes advantage of available laser sources and future improvements in optoelectronics.

Negative electron affinity is a condition that exists when the conduction band in the bulk GaAs is above the vacuum level energy at the surface. In the 1960's it was discovered that the application of cesium oxide to degenerately doped p+ GaAs and other III–V compounds could produce an effective negative electron affinity condition at the surface of the semiconductor. Negative electron affinity can be modeled as the formation of a heterojunction between GaAs and cesium oxide. Cesium oxide, which has a work function of $\sim$0.8 eV and an electron affinity of $\sim$0.55 eV, forms a heterojunction with the p+ GaAs surface. Fermi-level pinning at the surface of the GaAs, and the degenerate p+ doping, cause a band bending region $\sim$100 Å thick to develop. The electron diffusion length is much greater than the band bending distance.

Electrons that are excited into the conduction band near the surface of an NEA material do not encounter a surface barrier, and therefore can be emitted into vacuum. Quantum mechanical reflection at the surface and fast recombination surface states limit the electron-emission efficiency to several percent. In general, electrons are excited into the conduction band via laser excitation of electron hole pairs, but could also be injected from a nearby p-n junction. The advantage of photoexcitation is that very short optical pulses, $<$10 psec, can be used to produce correspondingly short electron pulses, i.e., high-speed (GHz) electron-beam blanking.

Each NEA array element consists of a patterned NEA cathode which is a matrix of small area dots inside a multi-element microlens addressed by corresponding decoders.

The three basic attributes of the massively parallel architecture of the invention are the following:

1. Imaging is performed by individually addressed electron beams. The number of beams would be large; an array of $500\times500$ beams or 250,000 beams is easily achievable.
2. Each electron beam can be individually focused or scanned, and all the electron beams can be scanned in parallel by an external (not at the cathode deflection system. However, the deflection field for this EBL architecture is very small, since it is only necessary to scan the area between adjacent cathode elements, typically 10 $\mu m$ to 100 $\mu m$ on a side.

3. A 4:1 or a 1:1 reduction system may be used to image the array cathode onto a wafer for pattern generation.

BRIEF DESCRIPTION OF DRAWINGS

The foregoing, and additional objects, features, and advantages of the present invention will become apparent to those of skill in the art from a consideration of the following detailed description of preferred embodiments thereof, taken in conjunction with the accompanying drawings, in which.

DESCRIPTION OF PREFERRED EMBODIMENT

Figure 1:
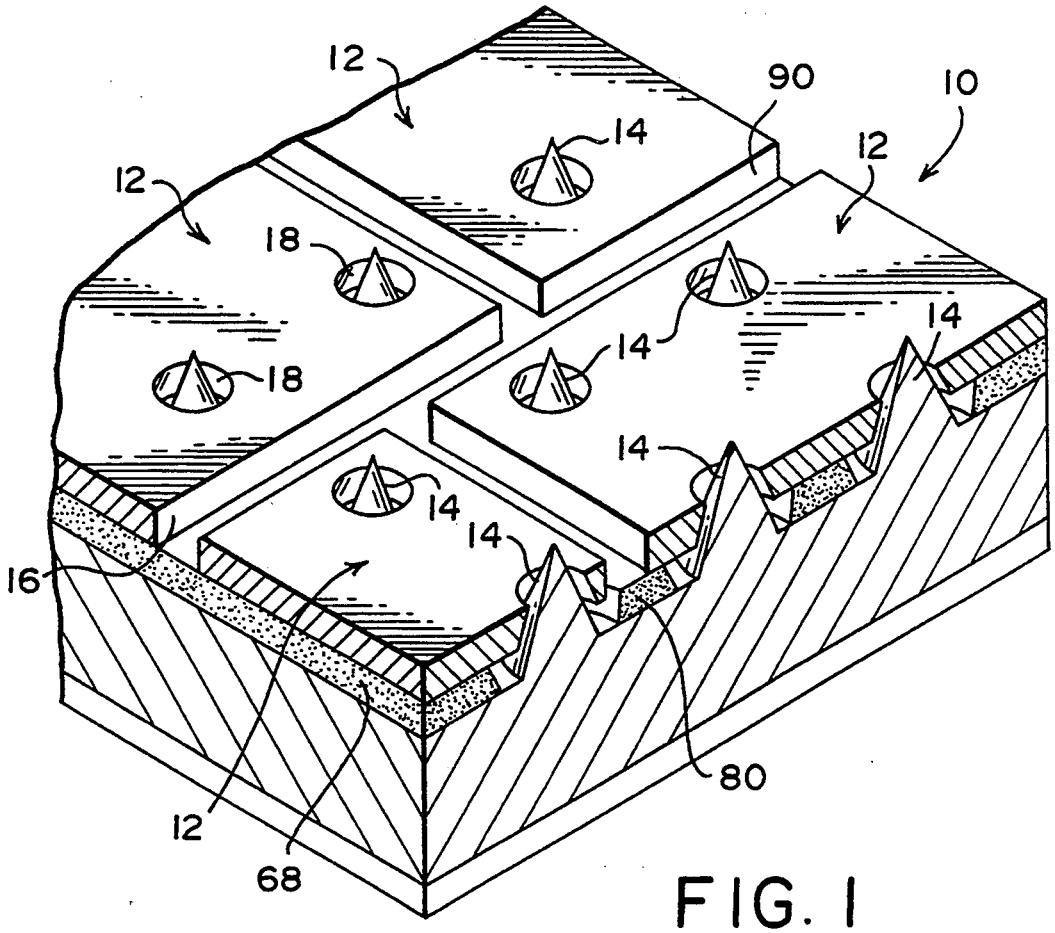
FIG. 1 is a perspective view of a multiple emitter structure for use in a massively parallel array cathode in accordance with the present invention.

Turning now to a more detailed consideration of the present invention, there is illustrated in FIG. 1 an emitter array 10 suitable for use in a massively parallel electron beam architecture in accordance with the present invention. The emitter tip array 10 consists of one or more cathodes 12, each of which has one or more emitter tips 14. The tips on a given cathode may be surrounded and thus controlled by an electrode layer 16, which layer may surround all of the emitter tips on a given cathode for simultaneous control of the electron emission from that cathode, or may surround individual emitter tips for individual control, as will be explained below. The electrode layer includes an aperture, such as aperture 18, surrounding each emitter tip, the apertures being closely spaced and self-aligned with the tips to provide precise control of electron emission.

Figure 2:
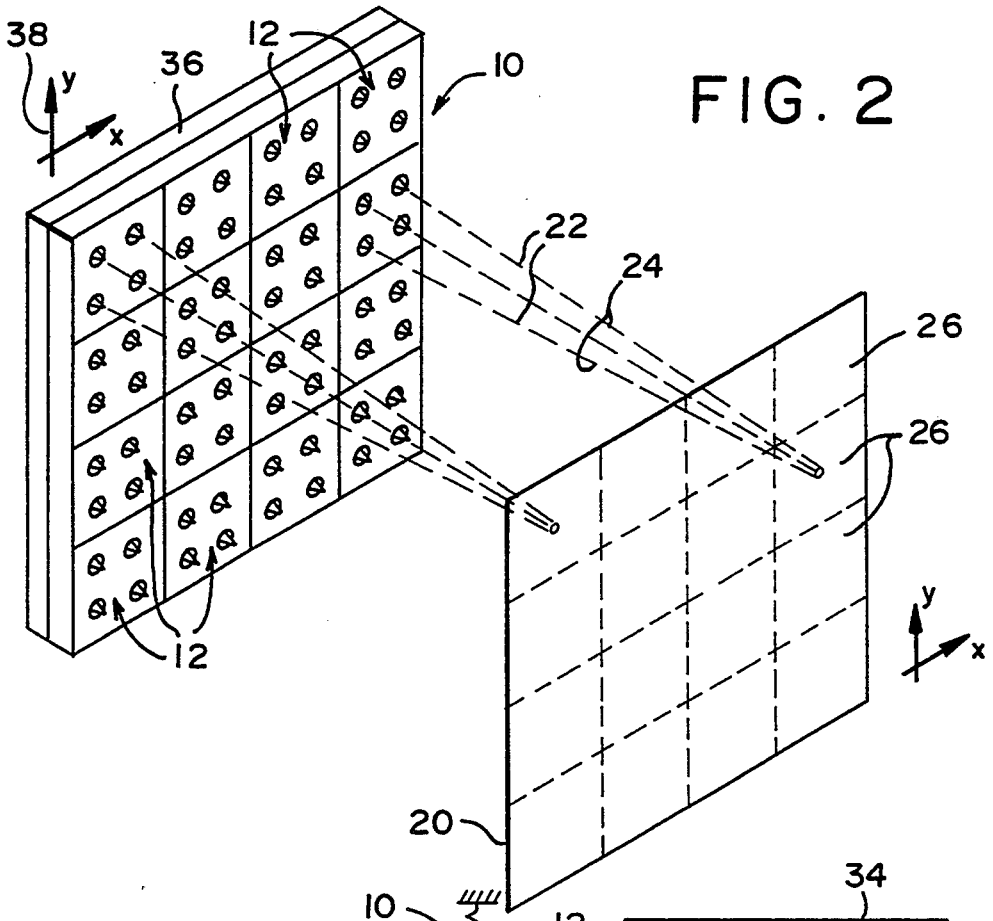
FIG. 2 is a diagrammatic perspective view of the array of the present invention.

The array 10 can be produced in essentially any practical dimension, and as illustrated in FIG. 2 may include an array of 16 cathode elements 12, each of which includes, for example, four emitter tips 14. The illustration of FIG. 2 is exemplary, and for purposes of illustration only, it being understood that a typical array may include as many as 250,000 emitters in an array 40 mm by 40 mm in area, with adjacent emitter tips being spaced by, for example, 80 μm. In the illustration of FIG. 2, electron streams, or beamlets from each emitter tip are directed toward a projection plane 20 which may be a phosphorus screen for a cathode ray tube, may be a semiconductor chip for photolithographic imaging, or may be any other desired target for an electron beam array. In the example illustrated in this figure, each emitter tip produces a stream of electrons 22, with all of the electron streams from a given cathode 12 producing an electron beam 24. The beam from a given cathode is directed, as by a focusing lens (not shown in FIG. 2) onto a corresponding target region, or tile, 26 on the projection plane. Each beam 24 illuminates only its corresponding target region, with each cathode beam being individually controlled to produce the exposure desired in that corresponding target region.

Although FIG. 2 illustrates a plurality of emitter tips for each cathode, it will be understood that a single tip may be provided on each cathode, the single tip producing the corresponding beam which illuminates a corresponding target region on the projection plane. Multiple emitter tips on each cathode provide redundancy for the emitter tips in case one should fail, and thus is preferred.

In addition to the focusing lens which directs each beam to its corresponding target region, mechanical, electrical or magnetic methods may be utilized, as will be described below, to scan all of the beams in the array 10 simultaneously. In addition, deflecting electrodes may also scan each beamlet individually. The beams 24 traverse their corresponding target regions 26 in a scanning pattern both horizontally and vertically, in the well known scanning patterns of, for example, conventional cathode ray tubes. Because 16 beams are provided, in the example of FIG. 2, to scan the total surface area of the projection plane 20, with each beam scanning only its own corresponding region, the entire surface of the projection plane can be scanned 16 times faster than would be possible with a single beam moving at the same rate. With suitable controls the individual beams can be switched on and off and scanned to produce any desired pattern or image on the projection plane 20, allowing rapid and accurate imaging of a surface with high resolution.

Figure 3:
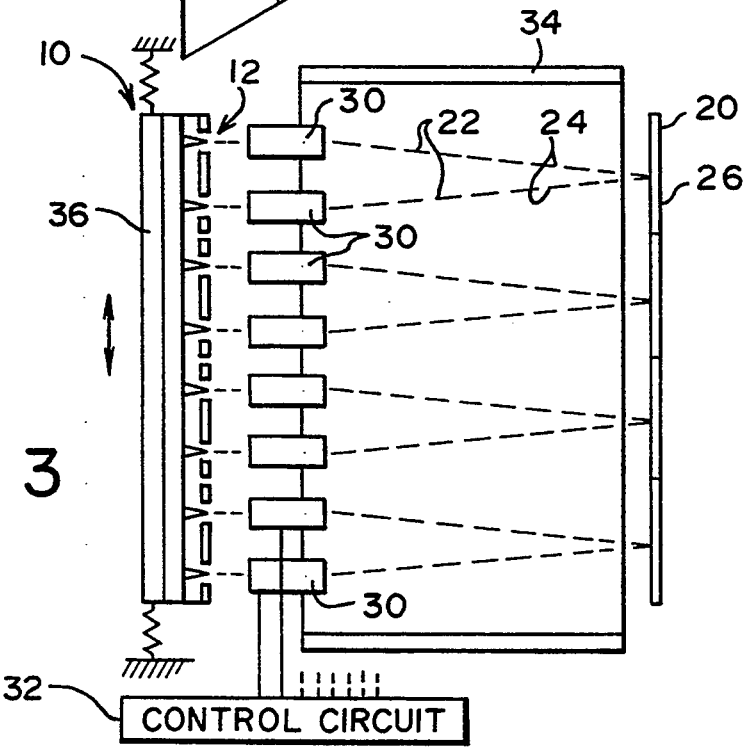
FIG. 3 is a side elevation view of the array of FIG. 2, modified to incorporate focusing optics.
Figure 5A:
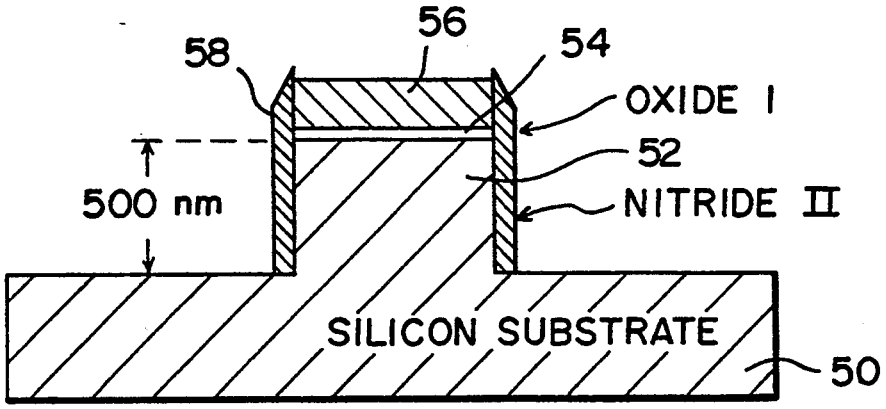
FIGS. 5(*a*)–5(*f*) illustrate in diagrammatic form the fabrication process for the emitters of FIG. 1.
Figure 5B:
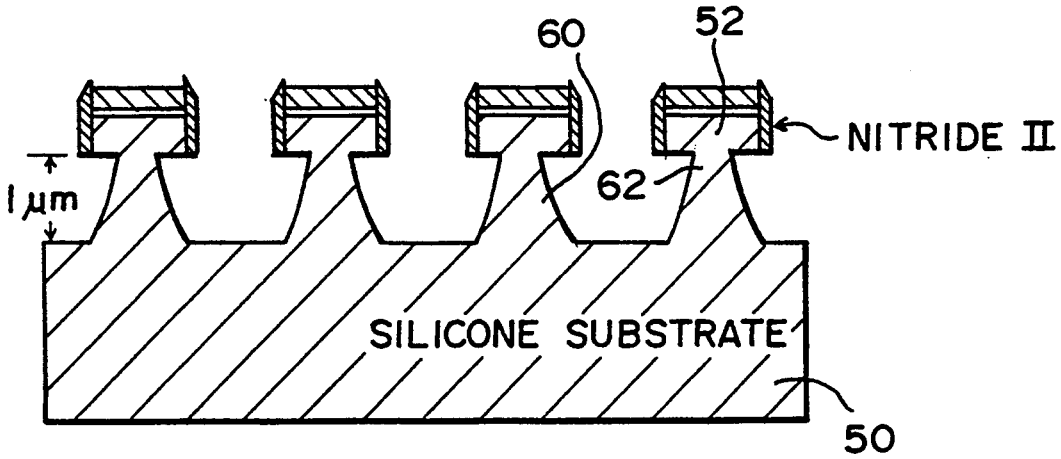
Figure 5C:
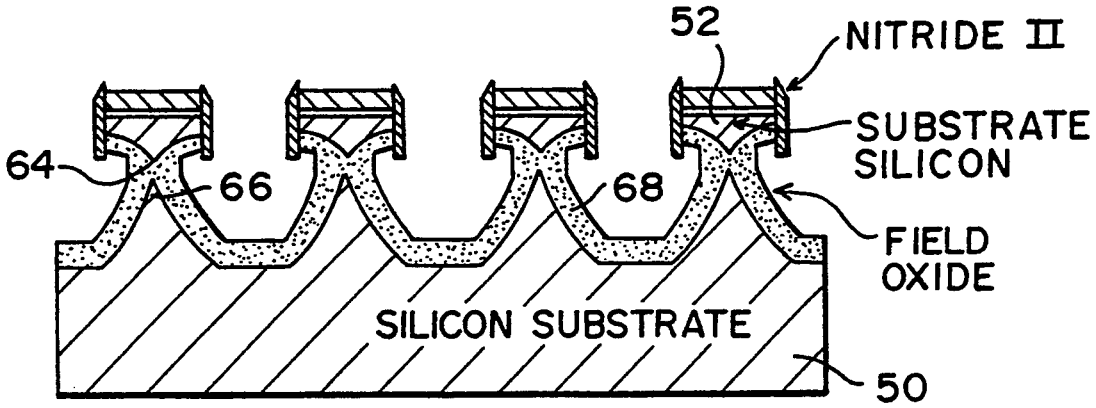
Figure 5D:
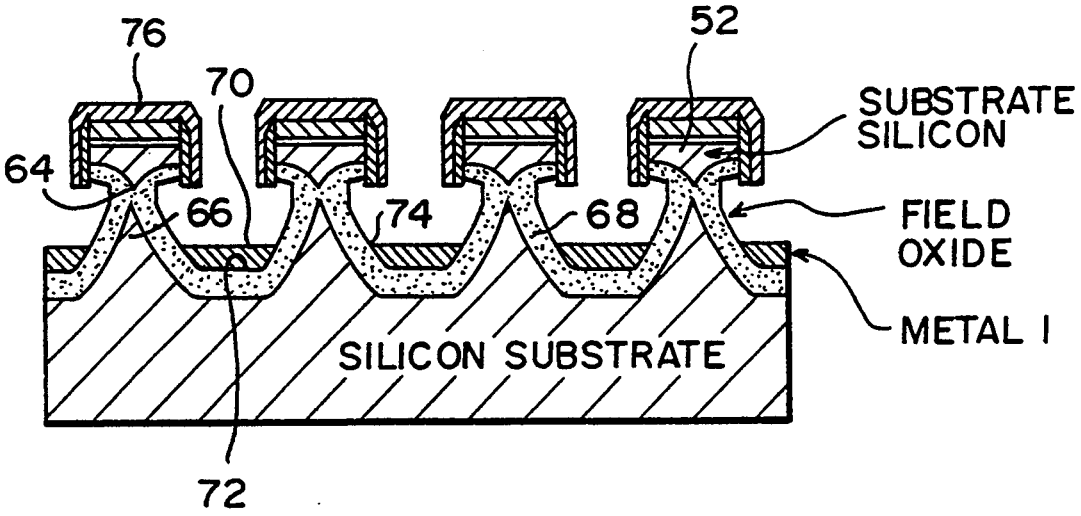
Figure 5E:
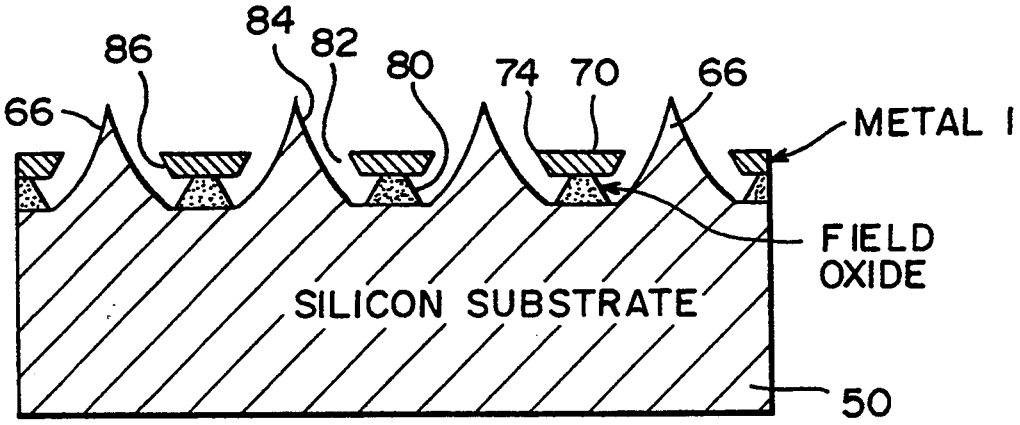
Figure 5F:
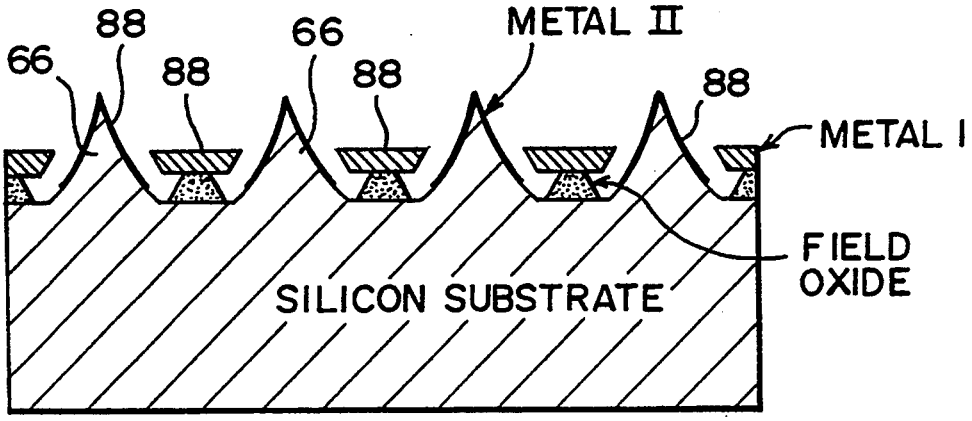

FIG. 3 illustrates a side elevational view of the device of FIG. 2, but further illustrates the provision of a plurality of lenses 30, each of which is positioned adjacent to and in the path of, a corresponding electron emitter. The lens 30 serves to direct its corresponding electron stream 22 toward a selected location on the corresponding target region 26 of the projection plane 20. Each lens 30 may be connected to a suitable control circuit, such as a circuit diagrammatically illustrated at 32, which provides suitable scanning voltages for each of the electron streams, whereby each stream may be individually controlled or each beam from a cathode may be controlled to produce the desired illumination of the target region and the desired scanning motion by individual control of the electron stream. Additionally, or alternatively, a coil, or plurality of coils 34 may be provided around the exterior of the path between the array 10 and the projection plane 20 so that all of the beams 24 may be simultaneously deflected if desired. If desired, instead of a coil surrounding the beam path between the array 10 and the projection plane 20, capacitive plates may be positioned adjacent this region to provide a deflection field.

Simultaneous deflection of all of the beams may also be obtained by mounting the array 10 on a substrate 36 which is, in turn, mounted for mechanical motion in the xy as plane indicated by arrow 38 in FIG. 2. Such motion of the substrate, and thus of the array 10, shifts all of the beams 24 simultaneously, enabling the beams to scan projection plane 20 in the x and y direction. Movement of the array 10 may be accomplished in the manner described and illustrated in copending application Ser. No. 08/069,725 of Noel C. MacDonald et al, filed Jun. 21, 1993 and entitled "Compound Stage MEM Actuator Suspended for Multidimensional Motion".

Figure 4:
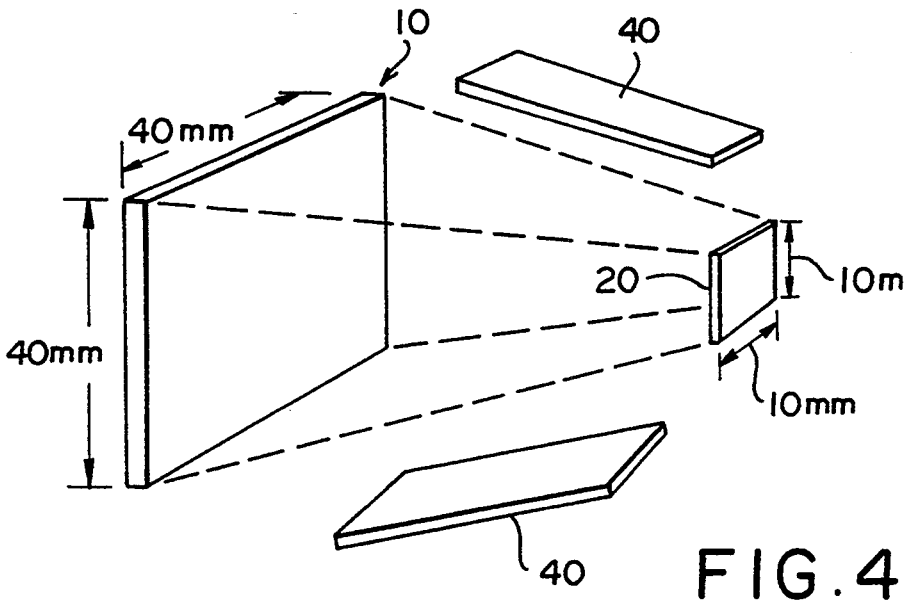
FIG. 4 is a diagrammatic illustration of the array of the invention used in an image reduction system.

As illustrated in FIG. 4, the projection plane 20 utilized in conjunction with the emitter array 10 may be reduced in size (or enlarged) so as to provide image reduction. Such reduction is particularly useful in lithographic applications, where resolution greater than the density of the array elements is required. Accordingly, as diagrammatically illustrated in FIG. 4, suitable reduction optics, such as deflection plates 40, may be provided adjacent the electron beam path to produce a selected reduction in the beam array area. Illustrated in FIG. 2, as an example, is a 4:1 reduction. A significant advantage of this arrangement is a reduction in the scanning distance of each electron beam. Thus, for example, if the spacing between each field emitter tip 14 in the array is 80 μm, the distance at the projection plane 20 between elements would be reduced by a factor of 4 so that the spacing between adjacent beams would be 20 μm. To cover the entire surface of the projection, it would only be necessary to scan all of the electron beams in parallel ±10 μm to obtain coverage of the entire projection plane area, thus allowing ease of scanning for lithography and like imaging processing.

A suitable process for fabricating the array cathodes 12 is illustrated in detail in U.S. Pat. No. 5,199,917, wherein submicron substrate-silicon islands are electrically isolated from the underlying silicon substrate by way of thermally-grown silicon dioxide. Single crystal silicon structures are formed by selective etching and silicon-nitride masking to obtain the desired structural characteristics. The process is fully described in the aforesaid U.S. Pat. No. 5,199,917, but is illustrated in general in FIGS. 5(*a*) through 5(*f*). The process begins with an arsenic-doped silicon wafer, or substrate, 50 having, for example, a bulk resistivity of 0.005 ohm-cm or less (see FIG. 5(*a*)). This low bulk resistivity offers the feasibility of obtaining highly doped silicon field emitter tips that are conductive. An oxide/nitride/oxide (ONO) stack is deposited on the top surface of the substrate, the first oxide layer being thermally grown. The nitride layer is a low pressure chemical vapor deposit layer which serves as the top mask for the subsequent isolation oxidation of the substrate silicon. The second oxide layer is obtained using plasma enhanced chemical vapor deposition and serves as the mask to prevent the underlying nitride film from thinning during the subsequent silicon island etch. The structural pattern of the emitters is transferred to the ONO stack, using tri-layer resist, direct-right electron-beam lithography, aluminum lift off, and anisotropic reactive ion etch (RIE). The substrate silicon is then etched to form islands 52 in the substrate, the islands being covered by the initial oxide layer 54 and the original nitride layer 56. A sidewall oxidation mask 58 is then formed by depositing a second oxide/nitride stack and then anisotropically etching it back using RIE to leave only the sidewall portion 58 intact.

As illustrated in FIG. 5(*b*), an anisotropic silicon recess etch is then performed using a fluorinated silicon etch to produce a vertical tapered silicon pedestal 60 beneath each of the islands 52, the pedestals extending upwardly from and being integral with the substrate 50. The pedestals are formed with a narrow neck portion 62 where they join their corresponding islands so that subsequent oxidation of the pedestals will separate the silicon islands from the pedestals at that location. This oxidation step is illustrated in FIG. 5(*c*), and shapes the tapered pedestal to form upper and lower opposed, spaced apart, vertically aligned silicon tips 64 and 66 in the islands and in their corresponding pedestals, respectively, within the oxide layer 68. The islands 52 are held in place by the oxide. This oxidation step also provides a uniform layer of oxide on the pedestals and on the horizontal surface of the substrate between the tips. The silicon tips 66 formed by this oxidation step are the emitter tips for the array, and the shape of these tips is a critical factor in providing a uniform emission from the emitter array. Since the oxidation of the pedestals advances essentially uniformly from all sides, the silicon material is removed uniformly, and this process continues until all of the silicon in the region of the narrow neck portion has been oxidized. The result is that the tapered silicon material terminates in a small conical tip having a diameter of less than 20 nm. The oxidation process is uniform throughout the array so that all of the emitters will be the same size with the same tip diameter.

As illustrated in FIG. 5(*d*), the next step is the deposition of gate electrode metal 70 on the top surface 72 of the horizontal oxide layer between the tips 66. This metal layer 70 surrounds the individual tips and is spaced therefrom by the thickness of the oxide layer 68 so that apertures 74 are formed in the metal in exact alignment with the tips. In addition, the metal layer 70 is spaced above the surface of the substrate by the oxide layer. It is noted that the metal layer 70 also covers the islands 52, as illustrated at 76.

As illustrated in FIG. 5(*e*), the oxide layer 68 is etched to lift of the islands 52 and their included upper tips 64 and further to remove the layer of oxide on the pedestal to expose the cone-shaped tapered tips 66. The oxide etching step also removes a selected portion of the oxide from the substrate surface by undercutting the gate electrode metal 70 adjacent the tips. This undercutting leaves oxide support pillars 80 between adjacent tips and beneath the gate metal to support the gate metal and hold it securely in place so that the apertures remain in alignment with respect to the tips.

Because the gap, illustrated at 82, between the surface 84 of a tip 66 and its corresponding gate electrode aperture 74 is determined by the thickness of the oxide layer formed on the pedestals, and since that thickness can be carefully controlled, not only can the gate electrode metal be spaced very close to the surfaces of the tip, but since the oxide layer is uniform around the circumference of each tip and throughout the array, the edges of the apertures in the metal will be uniformly spaced around each tip and gaps will be equal at all the tips. In addition, the sidewalls of 86 of the apertures in the gate electrode metal are sloped so as to be parallel to the surfaces of the conical tips which they surround, thereby further insuring accurate alignment and accurate spacing. This perfect alignment of the apertures in the electrode metal and the uniform gap between the edges of the apertures and the tip surface help to provide an accurately controllable emission array.

If it is desired to encapsulate the emitter tips with either a non-oxidizing metal or a metal with desirable emission characteristics, this may be accomplished, as illustrated in FIG. 5(*f*), by depositing, as by evaporation, a suitable metal layer 88. The undercut provided by the gate electrode 70 prevents this metal from forming a conductive path between the tips 66 and the gate electrode. This metal layer 88 can be gold, for example, while the metal layer 70 may be tungsten.

It is noted that the illustration of FIG. 5(*f*) is a cross section of the array of FIG. 1.

The array of emitters provided by the foregoing process may be divided into a plurality of cathode elements 12 by way of grooves 90 formed in the gate electrode layer 16. These grooves may be patterned to divide the array into groups of emitters, as illustrated in FIG. 2, or into separate single emitters, for control purposes. The dividing grooves 90 can be provided in the layer 16 by means of a gate electrode mask and a metal etching step. The surface layer 16 is covered, for example, by a photoresist layer and the desired pattern exposed through a suitable optical mask. A photoresist developing step is followed by a metal etching step to produce the groove through the thickness of the electrode layer 16. Thereafter, the photoresist layer is removed, leaving the patterned metal. Thereafter, suitable electrical connections may be made to the separate metal segments to provide control voltages to the gate electrodes surrounding corresponding emitter tips. These voltages can be used to switch the emitters on and off so as to control the presence or absence of corresponding electron streams 22.

Figure 6:
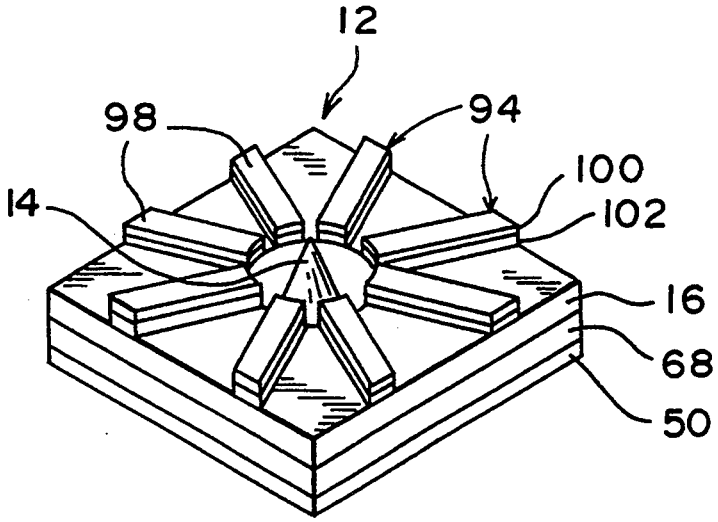
FIG.6 illustrates in diagrammatic perspective view an emitter with deflection electrodes.
Figure 7:
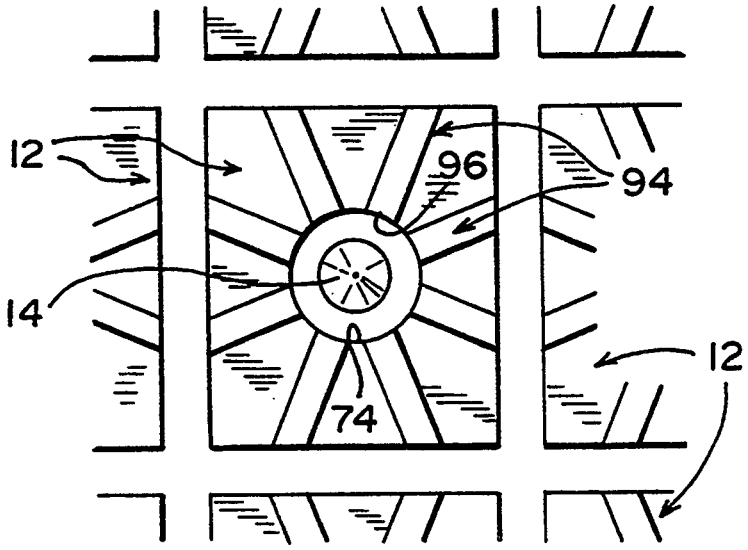
FIG. 7 is a top plan view of the device of FIG. 6 incorporated in an array.
Figure 8A:
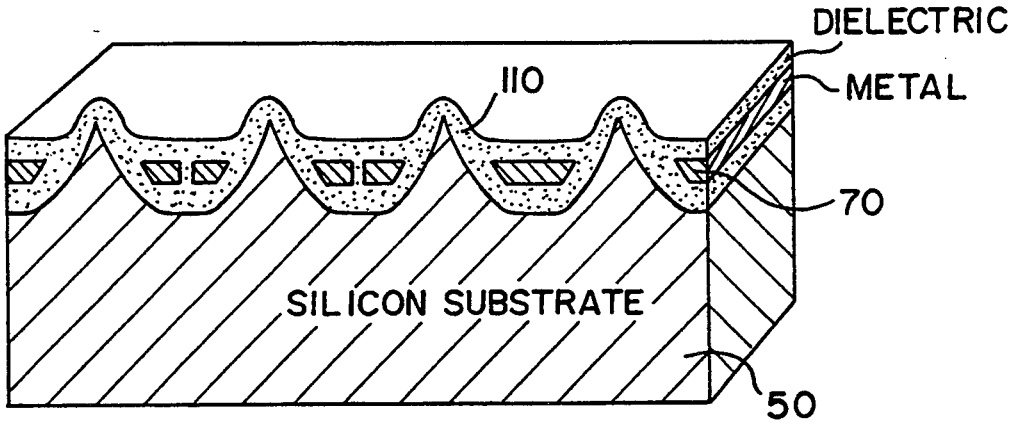
FIGS. 8(*a*)–8(*f*) illustrate in diagrammatic form a process for fabricating emitters having deflection electrodes, FIGS. 8(*a*), 8(*b*), and 8(*f*) being diagrammatic perspective views.
Figure 8B:
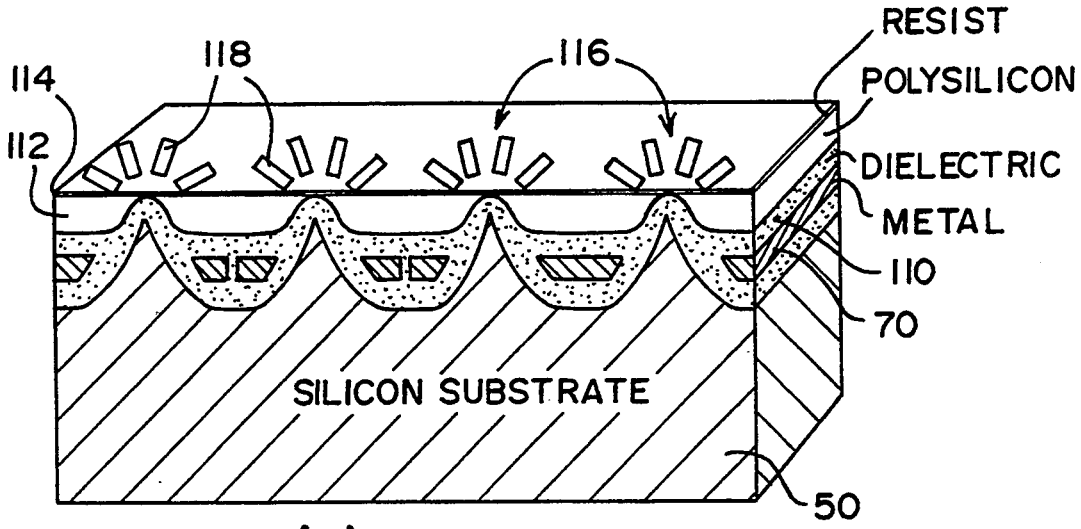
Figure 8C:
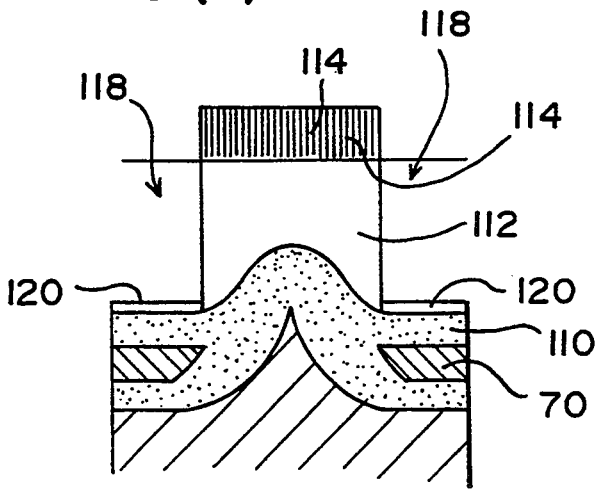
Figure 8D:
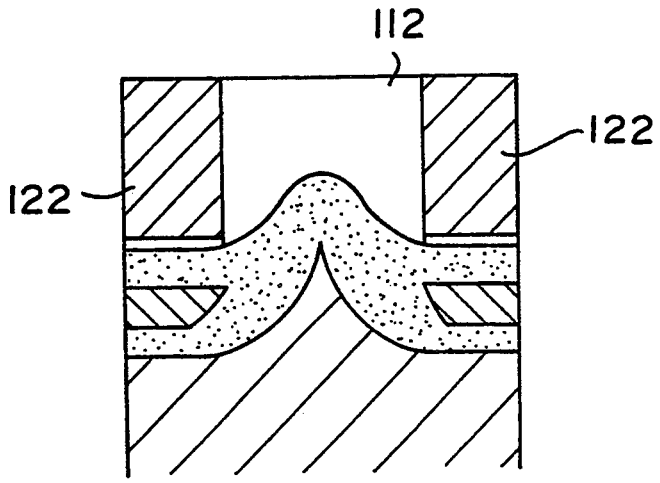
Figure 8E:
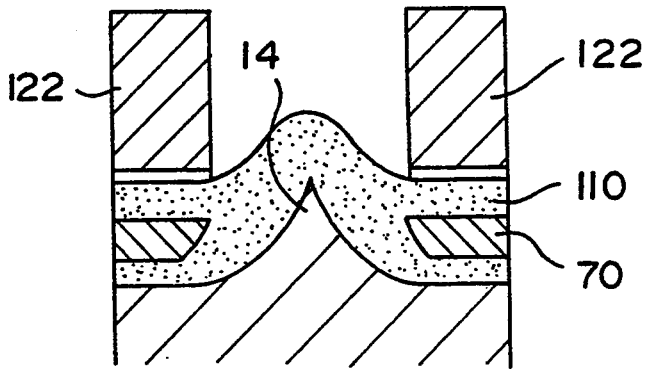
Figure 8F:
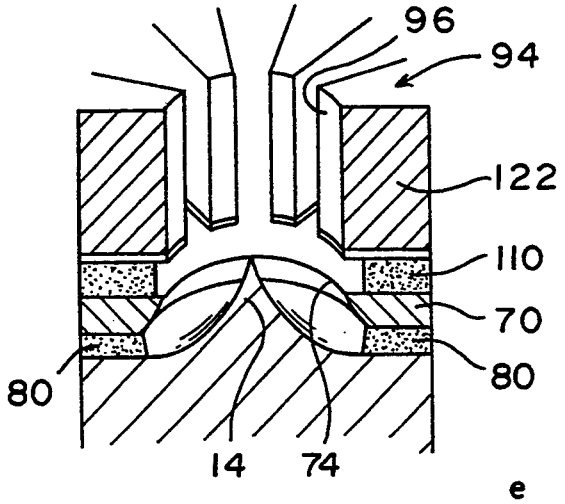

In a preferred form of the invention, a second conductor layer is provided above the layer 16 for use in producing potential fields in the region of the individual emitters for deflecting, shaping, and focusing the individual electron streams in order to focus the stream on the projection plane 20 and to provide scanning motion of individual streams in their corresponding target areas. In this way, each individual stream forms a beam for imaging the projection plane, if desired. FIGS. 6 and 7 illustrate a cathode 12 having an emitter 14 fabricated from substrate 50 and surrounded by control electrode 16, as previously described. In addition, the cathode 12 of FIG. 6 is provided with a plurality of deflection electrodes 94 spaced around emitter 14 with their inner ends 96 (see FIG. 7) aligned with the aperture 74 which surrounds the emitter tip. Eight deflection electrodes 94 are illustrated in FIG. 6, preferably symmetrically spaced around the emitter tip 14, although any number of such electrodes may be used, depending upon the degree of control required for the electron stream. The top surfaces 98 of the individual deflection electrodes may be connected into exterior control circuitry by suitable multilayer interconnects, such as the interconnects illustrated and described in U.S. Pat. No. 4,746,621 to David C. Thomas, et al.

As illustrated in FIG. 6, each electrode consists of a metal layer 100 insulated from the underlying metal electrode 16 by an insulating layer 102. These electrodes are fabricated using a second level metallization process such as that illustrated in FIGS. 8(*a*) through 8(*f*), to which reference is now made. This process is a modification of the process illustrated in FIGS. 5(*a*) through 5(*d*) in that after the formation of the opposed tips 64 and 66 illustrated in FIG. 5(*d*), the upper silicon islands 52 are removed by etching away the field oxide 68, and then the top surface of the wafer containing the array is coated with a thick silicon dioxide layer 110 as by plasma enhanced chemical vapor deposition (PECVD). A thick polysilicon layer is then deposited on top of the structure as indicated at 112 in FIG. 8(*b*), followed by a resist layer 114. Thereafter, the resist layer is patterned, as indicated by patterns 116 to define the control electrodes for each of the emitter tips. The patterning may be done by optical lithography, followed by development of the resist. Thereafter, the polysilicon layer 112 is etched using a high aspect ratio etching to produce trenches 118 in each of the locations where a deflector electrode is to be positioned, as defined by pattern 116. The trenches extend down through the polysilicon layer 112 to the silicon dioxide layer 110.

As illustrated in FIG. 8(*c*), the bottoms of the trenches are coated with a thin layer of a seed layer such as Au or Pd. This seed layer is very thin, and after it has been deposited, the resist layer 114 is removed, carrying away any seed metal which might have been deposited thereon. The remaining trenches 118 are then filled with copper, as indicated at 122 in FIG. 8(*d*). This copper may be from an electroless ionic bath which selectively deposits copper in the trenches.

As illustrated in FIG. 8(*e*), the polysilicon layer 112 is next removed, exposing the silicon dioxide layer 110. Finally, as illustrated in FIG. 8(*f*), the silicon dioxide is removed to expose the tip 14, leaving the surrounding deflection electrodes 94, described above with respect to FIG. 6, as well as the control electrode 70 supported by pedestals 80. It is noted that the silicon dioxide layer 110 in FIG. 8(*f*) corresponds to the insulating layer 102 described with respect to FIG. 6, while the metal 122 in FIG. 8(*f*) corresponds to the metal layer 100 described in FIG. 6.

The control electrode 70 as well as each of the deflection electrodes 94 are connected by suitable conductive paths fabricated in accordance, for example, with the teachings of U.S. Pat. No. 4,746,621 for connection to suitable control circuitry, whereby voltages of selected values may be applied to the deflector electrodes to focus, deflect, and shape the stream of electrons emitted by emitter 14. Conventional addressing techniques are used to select and supply voltages to the various electrodes in each cathode and in an array of cathodes and their included emitters.

Figure 9:
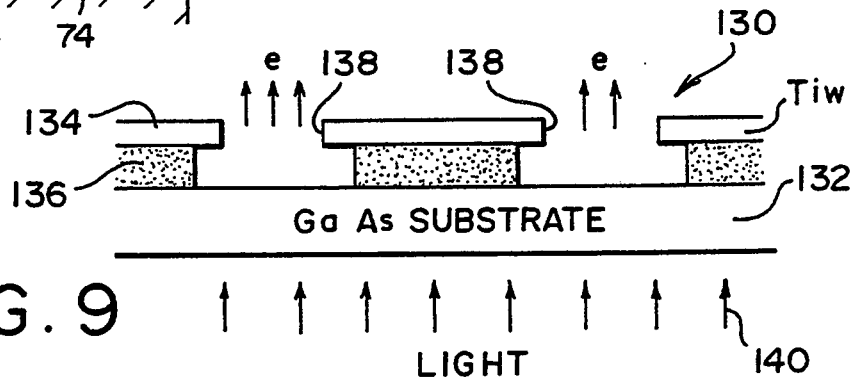
FIG. 9 is a diagrammatic illustration of NEA electrodes.

Although the foregoing description has been directed primarily to the use of single crystal silicon field emission cathodes, the invention may also be used in conjunction with negative electrode affinity emitters, as described above. Such an emitter is diagrammatically illustrated in FIG. 9 at 130. This device includes a GaAs substrate 132 having a metal control electrode 134 mounted on the surface of the substrate by insulating layer 136. The electrode defines a plurality of emitter apertures 138 through which the photocathode substrate 132 emits electrons upon illumination of the substrate by light 140 as from a laser source.

Figure 10:
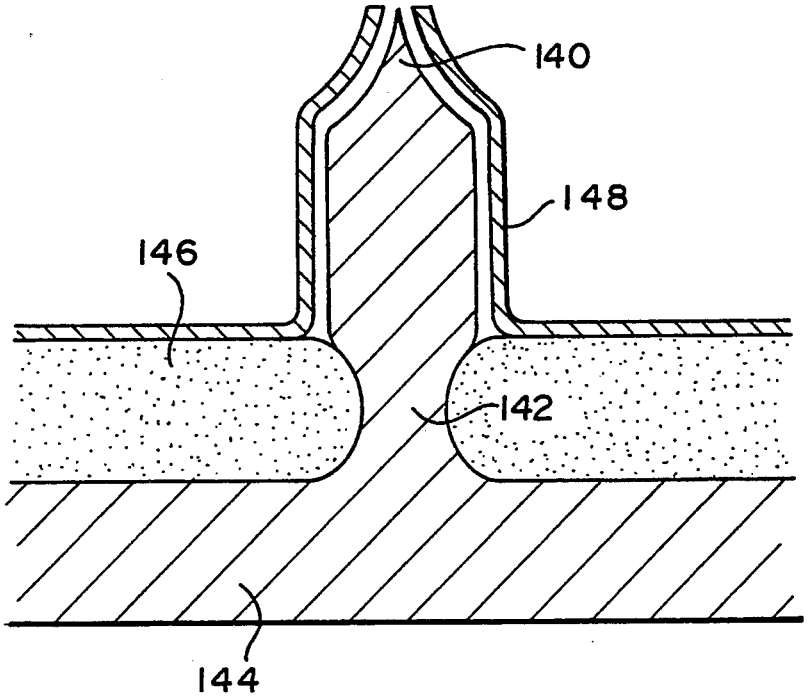
FIG. 10 is a diagrammatic illustration of an emitter incorporating a series resistor.

A major cause of failure in high density field emitter arrays is excess current flow which can burn the very small tips. FIG. 10 illustrates an improved emitter tip which can be utilized in the arrays described hereinabove. In this structure, the tip 140 is fabricated on a silicon post 142 which in turn is supported on the single crystal silicon substrate 144. In fabricating the tip of FIG. 10, the substrate is doped to provide a 30 ohm-cm n-type silicon substrate so that the post becomes a resistor of approximately 5 Mohm to provide an effective buffering of the tip 140. A planarized silicon dioxide layer 146 covers the silicon substrate and buries the post 142, which is a recessed island portion fabricated in the manner described above with respect to FIGS. 5(*a*) through 5(*c*).

The emitter tip may be surrounded by a control electrode such as that illustrated in FIG. 5(*d*), in which case the silicon dioxide layer 146 would be thicker than that illustrated in FIG. 10, or may be provided with a gate electrode such as that illustrated at 148 in FIG. 10. This electrode lies on the top surface of the silicon dioxide layer 146 and extends upwardly to surround the tip 140. This grid electrode is spatially isolated from the tip to reduce the capacitance between the gate electrode and the emitter and thereby provide an increase in switching speed and a decrease in current leakage during device operation. The gated field emitter illustrated in FIG. 10 may have a gate aperture in the range of 300 nm, and the tip 140 may be in the range of 20 nm as described above. Tip 140 may be coated with a low work function material such as that illustrated in FIG. 5(*f*).

The emitter of FIG. 10 may be incorporated in the array described with respect to FIGS. 8(*a*) through 8(*f*) by adjustment of the thickness of the various dielectric layers so as to provide deflection electrodes above the tip 140.

Thus, there has been described a new and unique massively parallel array cathode in which large numbers of emitters are provided which can either singly or in groups direct controllable electron beams to small target regions for improved image production for applications such as flat screen image devices, lithography, and the like. Each cathode in each array may have multiple emitters, and the beams produced by the cathodes are operated in parallel. Each beam is directed to a corresponding region of the image to be produced so that rapid, high resolution scanning can be produced. The scanning can be carried out individually by means of deflection electrodes for each emitter, or can be carried out in parallel for single or multiple cathodes. The use of single crystal silicon for the preferred form of the invention allows integration of the system with conventional circuitry for addressing and controlling individual emitters for reliable electrical control of the cathodes. In addition, scanning can be carried out mechanically by moving the cathodes through precisely controllable submicron microelectromechanical structures. Although the invention has been described in terms of preferred embodiments thereof, it will be apparent that modifications can be made without departing from the true spirit and scope thereof as set forth in the accompanying claims.

What is claimed is:

1. A massively parallel electron beam array, comprising:

a substrate;

a multiplicity of submicron emitter tips fabricated from said substrate for producing corresponding electron emission streams, said tips being separated into a plurality of groups of one or more, each group being electrically isolated from all remaining groups, said groups comprising a plurality of cathodes;

an emitter control electrode for each of said multiplicity of emitter tips for controlling corresponding emitter electron emission streams;

a cathode control electrode for each of said plurality of cathodes for producing from the electron emission streams of each cathode a corresponding single cathode beam, said plurality of cathodes producing an array of beams;

a target for receiving said array of beams, each beam striking a corresponding target region whereby each target region is illuminated by a corresponding beam; and a deflector for said cathode array for deflecting all of said beams of said array simultaneously with respect to said target.

2. The array of claim 1, wherein each said emitter tip is fabricated from a single crystal silicon substrate the tip comprising a post which is integral with and extends upwardly from the substrate, the top of the post being tapered to form a tip having a diameter less than 20 nm.

3. The array of claim 2, wherein each said post has a resistance of about 5 Mohm.

4. The array of claim 1, wherein the spacing between each of said multiplicity of tips is about 80 $\mu$m.

5. The array of claim 1, wherein each said tip is coated with a low work function material.

6. The array of claim 1, wherein said deflector includes said substrate mounted for mechanical motion in an xy plane.

7. The array of claim 1, wherein said deflector includes reduction optics for said array of beams.

8. The array of claim 7, wherein said cathode control electrodes are located to permit scanning of each said cathode beam with respect to its corresponding target region.

9. The array of claim 1, wherein said emitter control electrode for each of said tips comprises focusing means for each said stream.

10. The array of claim 1, wherein said emitter control electrode for each of said tips comprises means for scanning each of said emission streams.

11. The array of claim 1, wherein said deflector for scanning said array of beams simultaneously includes means for mechanically moving said cathodes in a plane defined by said cathodes.

12. The array of claim 1, wherein said emitter control electrode comprises a first metal layer surrounding said emitter tips.

13. The array of claim 12, wherein said cathode control electrode comprises a second metal layer surrounding said emitter tips and spaced from said first layer.

14. The array of claim 12, wherein said deflector comprises a plurality of metal electrodes surrounding each said emitter tip and spaced above said first tip.

15. The array of claim 14 further including control means for selectively energizing said control electrode and said deflector electrodes for each emitter tip for controlling the electron stream produced by each said tip.

* * * * *